United States Patent [19]

West

[11] Patent Number: 4,845,973

[45] **Date of Patent: * Jul. 11, 1989**

[54] CLIP PLIERS

[76] Inventor: Robert J. West, R.F.D 1, Box 682, Pownal, Me. 04069

[ * ] Notice: The portion of the term of this patent subsequent to Nov. 29, 2005 has been disclaimed.

[21] Appl. No.: 242,489

[22] Filed: Sep. 12, 1988

Related U.S. Application Data

[63] Continuation-in-part of Ser. No. 80,427, Jul. 31, 1987, Pat. No. 4,787,236, which is a continuation-in-part of Ser. No. 863,856, May 16, 1986, abandoned.

[51] Int. Cl.[4] ..... B21D 7/06; B21F 45/16

[52] U.S. Cl. ..... 72/410; 81/362

[58] Field of Search ..... 72/410, 409; 81/362, 81/346, 416, 355, 363; 29/243.56; 227/48, 144, 143

[56] References Cited

U.S. PATENT DOCUMENTS

| | | | |
|---|---|---|---|
| 130,853 | 8/1872 | Hill | 72/410 |
| 689,721 | 12/1901 | Holland | 72/410 |
| 2,174,152 | 9/1939 | Curtiss | 72/410 |
| 2,555,903 | 6/1951 | Schroeder | 72/410 |
| 2,756,427 | 7/1956 | Van Zante | 72/410 |
| 2,777,345 | 1/1957 | Reider, Jr. | 72/409 |
| 3,945,238 | 3/1976 | Eckert | 29/243.56 |
| 4,313,333 | 2/1982 | Malagnoux et al. | 29/243.56 |

FOREIGN PATENT DOCUMENTS

| | | | |
|---|---|---|---|
| 2231480 | 12/1974 | France | 29/243.56 |

*Primary Examiner*—Daniel G. Crane
*Attorney, Agent, or Firm*—William Nitkin

[57] ABSTRACT

A hog ring type clip applying device having an upper jaw and a lower jaw to receive and clench the clip with the lower jaw attached to a rear handle and the upper jaw attached to a diagonally disposed lever member, such lever member and rear handle pivotally attached near the tops thereof and a front handle pivotally attached to the bottom portion of the lever member, such front handlt having a slot disposed at the top thereof to receive therethrough the upper and lower jaws with spring members to urge the front handle apart from the rear handle and a clip feed to direct clips along a clip side to a clip receipt area between the upper and lower jaws, such device when the front and rear handles are moved together, adapted to grasp a clip from the end of the clip side, move the jaws forward through the slot in the top of the front handle to an advanced position where the front and rear handles can be further moved together causing them to clench the clip around what is desired to be clipped.

1 Claim, 5 Drawing Sheets

FIG. 10
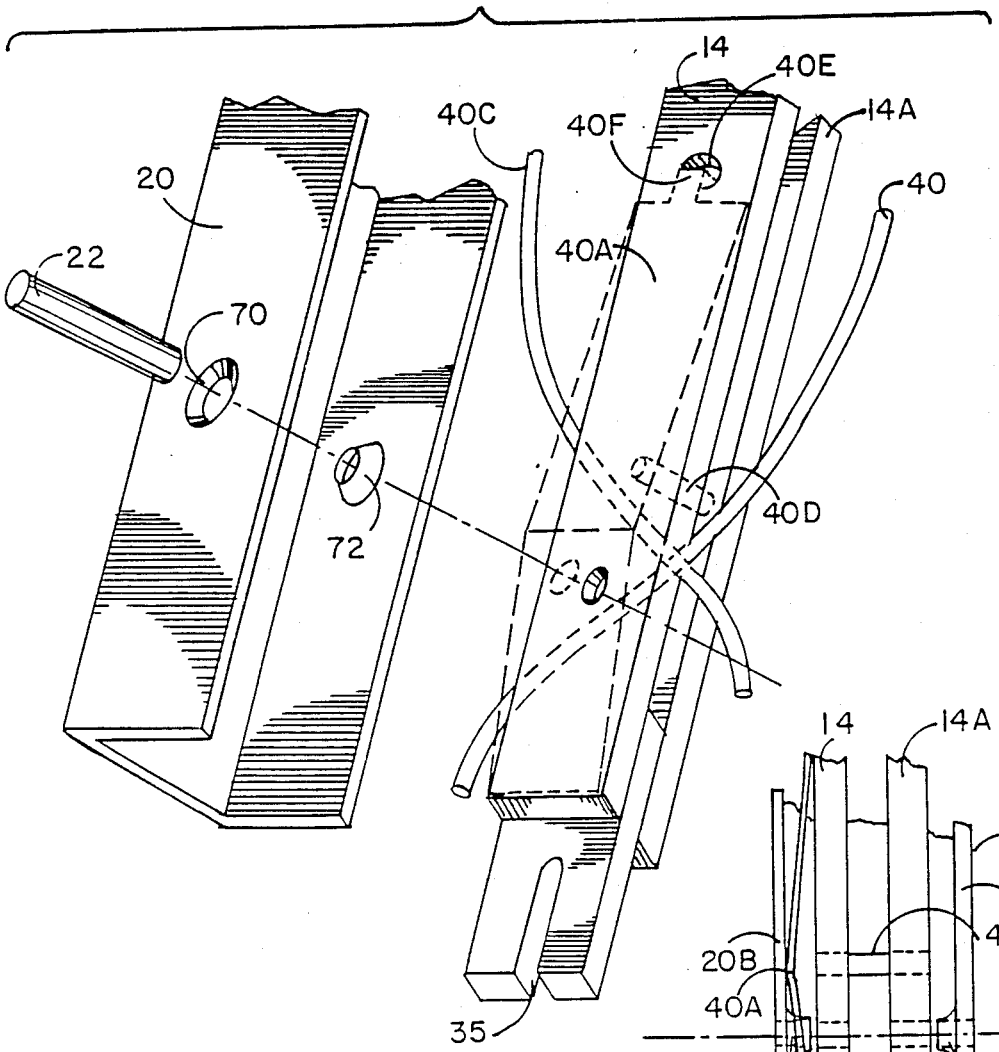
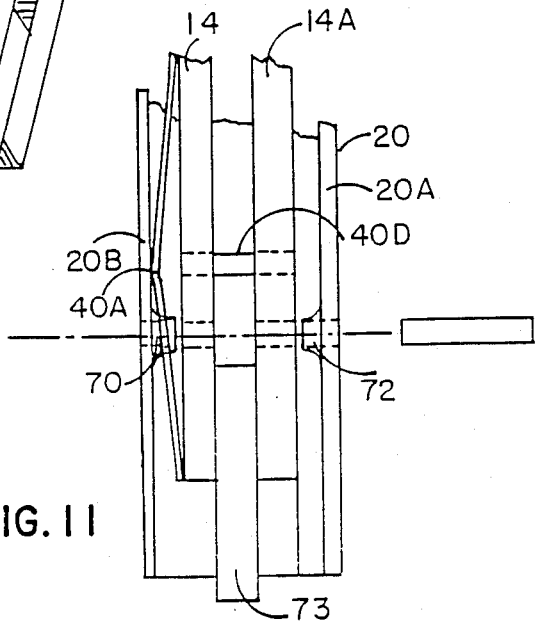
FIG. 11

CLIP PLIERS

This application is a continuation-in-part of my previous application for Clip Pliers filed July 31, 1987, Ser. No. 080,427 now U.S. Pat. No. 4,787,236 which was a continuation-in-part of my previous application for Clip Pliers filed May 16, 1986, Ser. No. 863,856 now abandoned.

BACKGROUND OF THE INVENTION

1. Field of the Invention

The device of this invention resides in the art of pliers for applying clips and more particularly relates to the type of hand-operated clip applier which uses closing jaws to apply hog ring type clips.

2. Description of the Prior Art

There are many well known clip appliers in the prior art relating to hog ring type clips. Pliers of the type based on the principle of closing jaws are disclosed early in the prior art. For example in U.S. Pat. No. 130,853 of 1872 to H. W. Hill entitled Improvements in Instruments for Ringing Hogs the hog ring clips are shown applied by pliers having a jaw with slots formed to hold the rings. Many other jaw-type clip appliers have been developed over the years. Such prior art includes a variety of manually and pneumatically operated clip pliers for clenching hog ring type clips with jaw members which close around the clip to clench the clip around the desired object(s).

SUMMARY OF THE INVENTION

It is an object of this invention to provide improved pliers which can be manually operated, but which also could be pneumatically operated if desired, which are easy to use, which have an improved feeding system and clenching system whereby the jaws protrude away from the body of the pliers to easily apply the clip in hard-to-reach places.

It is a further object of this invention to provide a simple tool which is jam-resistant and which will easily feed each clip and also hold a plurality of clips in a row for installation. The tool of this invention will easily apply the clips in a direction and fashion that is easy to handle for the individual holding the device in that the clips are applied in front of the hand rather than applied awkwardly above the hand as is frequently the case in the prior art.

BRIEF DESCRIPTIONS OF THE DRAWINGS

FIG. 10 illustrates a perspective separated view of the inside handle base with the lever member moved out of the handle.

FIG. 11 illustrates a rear view of the inside of the handle base.

DESCRIPTION OF THE PREFERRED EMBODIMENT(S)

Figure 1:
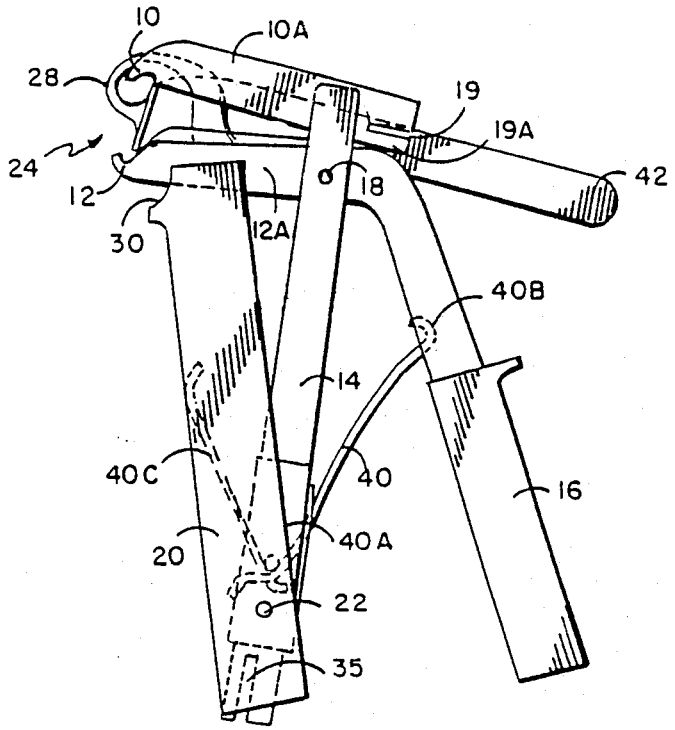
FIG. 1 illustrates a left side view of the device of this invention.
Figure 2:
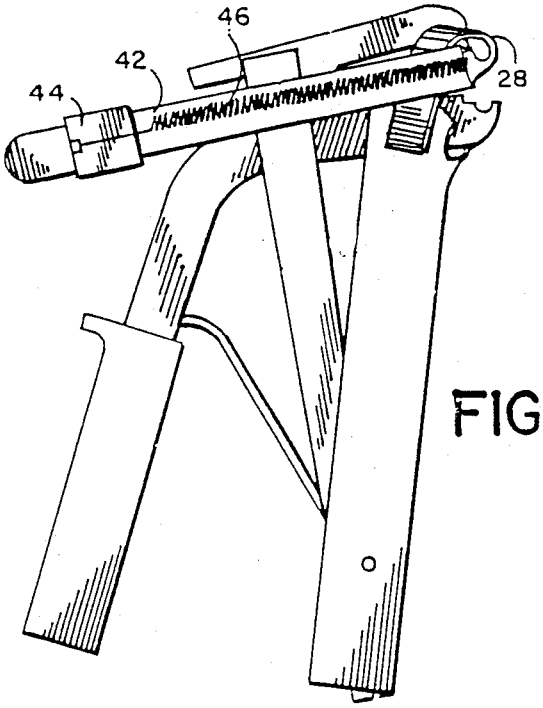
FIG. 2 is a right side view of the device of this invention.
Figure 5:
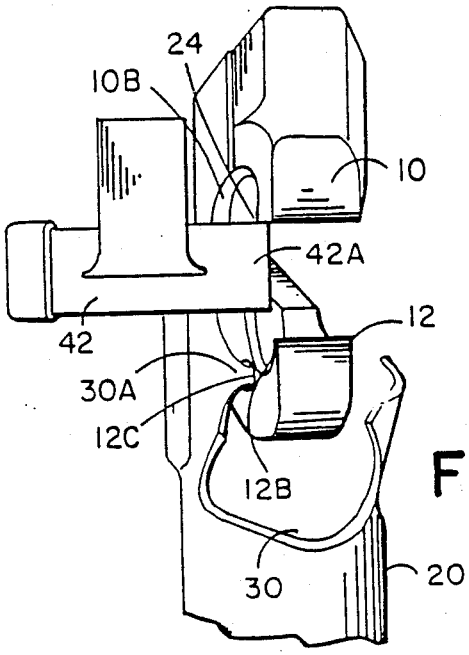
FIG. 5 illustrates an enlarged front view of the upper portion of the device showing the clip feed and jaw receipt area.
Figure 6:
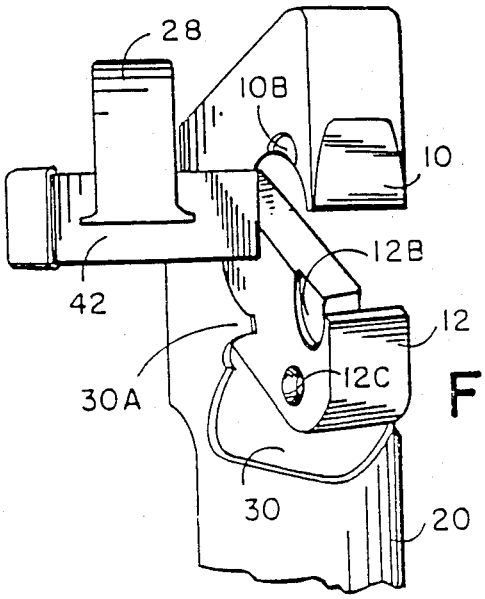
FIG. 6 illustrates the enlarged front view of FIG. 6 with the jaws moved forward and laterally away from the clip slide.
Figure 6A:
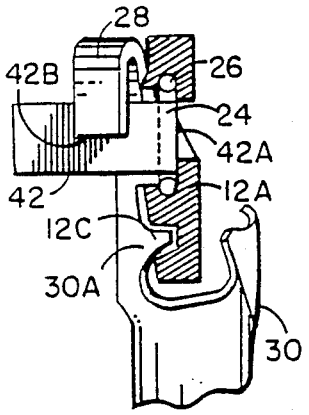
FIG. 6A illustrates enlarged front view of FIG. 6 with portions of the jaws cut away and a clip in place.
Figure 6B:
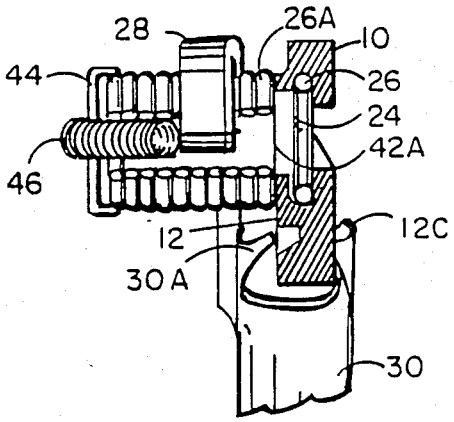
FIG. 6B illustrates enlarged front view of FIG. 6 with portions of the jaws cut away and a clip in place with the jaws moved forward.
Figure 6C:
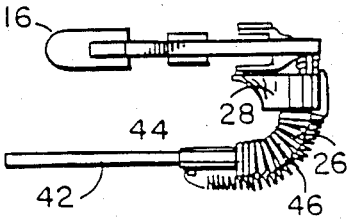
FIG. 6C illustrates a top view of the device of this invention.

FIG. 1 illustrates a left side view of the device of this invention showing upper jaw 10 and lower jaw 12. The jaws are on the ends of upper jaw member 10A in which upper jaw 10 is formed in the front thereof and the lower jaw member 12A in which lower jaw 12 is formed in the front thereof. Each jaw member 10A and 12A extends rearward from jaws 10 and 12 respectively. The upper jaw member 10A extends to its end which has an adjustment means which will be described below, such upper jaw member 10 being attached to lever bar 14 which extends downward substantially perpendicular therefrom. Lower jaw member 12A continues beyond the lever member 14 as seen in FIG. 1 and then extends at an angle downwards to form rear handle 16. The upper jaw member 10A and its attached lever bar 14 are pivotally attached at first pivot 18 to lower jaw member 12A and rear handle 16 so that if one moves the rear handle 16 back and forth in relation to lever bar 14, upper jaw 10 and lower jaw 12 open and close together. Lever bar 14 can be formed by two parallel members extending on either side of lower jaw member 12A. Front handle member 20 is provided which is attached at its bottom by second pivot member 22 to the lower portion of lever bar 14. At the top of front handle 20 is slot 30 in which lower jaw 12 and jaw member 12A pass. On the right side of front handle 20 as seen in FIG. 2 is clip slide attachment projection 28 which extends upward and then around to the front where it is attached to clip slide 42. It is attached to clip slide 42 at the front 42B thereof as seen in FIG. 6A so that when clip 26 is moving along clip slide 42 which extends first outward from the clip slide attachment projection 28 and then toward the rear of the device, the forward-facing open portions of each clip 26 will pass around the attachment 42B of the clip slide attachment projection 28 to clip slide 42 itself. A pusher member 44 as seen in FIG. 2 which slides along clip slide 42 at the rear of the series of clips 26 is attached to the clip slide projection by an elastic band or spring 46 which urges clips 26 in front thereof always to progress along clip slide 42 to clip receipt area 24 formed between the jaws 10 and 12 as seen in FIG. 5. Each jaw may have a portion 10B and 12B cut out therefrom adapted to receive and securely contain the shape of the clip when the jaws are closed therearound. It should be noted that the clip slide 42 extends completely into clip receipt area 24 and would, if nothing further were done, prevent the forward advancement of the jaws since clip slide 42 then protrudes in front of the upper and lower jaw members 10A and 12A. This protrusion though is of great advantage for the positioning of the clips so that continuous clip feed action can be easily accomplished clip after clip because the position of each clip 26 is correctly established between jaws 10 and 12 when they close around the clip. To this end the device as seen in FIG. 5 and 6A contains at the right side of the upper portion of slot 30 an inward protruding projection 30A and a mating hollow 12C is formed in the right side of lower jaw member 12A which receives the projection therein. Flat spring member 40A as seen in FIG. 1 which is located on the side of the base of lever bar 14 between it and the inside of hollow front handle 20 urges lever bar 14 and jaws 10 and 12 toward the right side of slot 30 against projection 30A. This action forces lever member 14 and attached upper and lower jaws 10 and 12 to the right side of slot 30 seen in FIGS. 5 and 6A where the front portion of the jaws and clip rae cut away and when the device is in its inactive position hollow 12C receives projection 30A therein which allows the jaws to move further to the right causing the end 42A of clip slide 42 to be in clip receipt area+24. In FIG. 6C, a top view of the device, clip slide 42 is seen having a plurality of clips 26 thereon. These clips are moved forward on the clip slide to clip receipt area 24 by the pressure of pusher 44 which is pulled by spring 46 or equivalent which is attached to clip slide attachment projection 28 and is under tension when the pusher to which it is attached is positioned rearward on clip slide 42 when a plurality of clips are slid thereon. In this position the unit is ready to receive a clip. When activated by a user, as will be described in further detail below and seen in FIG. 6 and 6B where the front portion of the jaws and clip are cut away, projection 30A slides out of hollow 12C as hollow 12C is moved forward away from projection 30A and projection 30A then contacts the side of lower jaw 12 effectively pushing the jaws to the left against the pressure of leaf spring 40A which moves the clip receipt area laterally to the left away from end 42A after the clip has been securely grasped between the upper and lower jaws 10 and 12. In this fashion a secure grasping of each clip 26 can be accomplished as each clip is held in position on clip slide 42 while it is being seized by the upper and lower jaws 10 and 12 and then, as upper and lower jaws 10 and 12 are advanced forward by the use of the pliers as described below, they securely hold the clip within the upper jaw clip receipt area **10*b* and the lower jaw clip receipt area 12B while the right side of the jaw members then pass by end 42A of the clip slide member 42 retaining thereon the next clip 26A which is being urged forward by pusher 44 from the pressure of spring 46 thereagainst and which jaws prevent the clips from further forward movement while the preceding clip 26 is being installed by the actions as will be described further below. After installation when jaws 10 and 12 move rearward and empty clip receipt area 24 is again in position at the end 42A of clip slide 42, hollow 12C is also in front of projection 30A and the upper and lower jaw members 10A and 12A are pushed laterally by spring 40A back into proximity with the end 42A of clip slide 42 as projection 30A enters hollow 12C which action then directs the next clip immediately into its proper positioning between the upper jaw area 12B and lower jaw area 10B for the clip installation. Upper jaw area 12B and lower jaw area 10B** are shown wide enough to accommodate clips of different wire diameter sizes.

Figure 9:
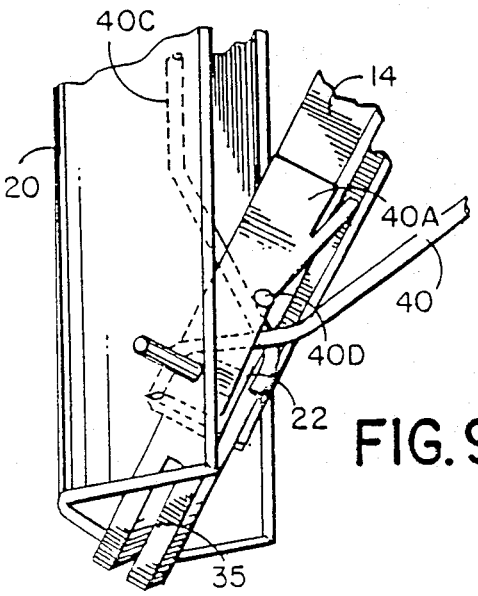
FIG. 9 illustrates a perspective sectional view of the base of the handle and lever member.

At the other end of upper jaw member 10A beyond lever bar 14 as seen in FIG. 1 is adjustment slot 19 which can be utilized to adjust the size of the opening of the clip receipt area 24 between upper jaw 10 and lower jaw 12 by inserting a tool therein and bending lower portion 19A of the upper jaw member downward which then will change the angular relation of the jaw and reposition upper jaw 10A at a different distance from lower jaw 12A as needed. Also, a second adjustment slot 35 is provided at the base of lever member 14 which can adjust by spreading or compressing the sides thereof the forward movement of front handle 20 to adjust the position of clip slide 42 in receipt area 24. Second adjustment slot 35 can be adjusted in a similar fashion to slot 19 with a tool spreading either side of the slot apart. A spring member 40 can pass from a slot 40B in the rear handle wherein it slides to urge the rear handle rearwards which spring 40 has a front portion extending around post 40D adapted to urge rear handle 16 rearward. A second spring 40C extends from inside hollow front handle 20 as seen in FIG. 9 also around post 40D to inside of lever member 14 to urge front handle 20 forward. In this way the device is always urged apart as in FIG. 1 until it is time to operate it and pull the various parts together as will be described below.

Figure 3:
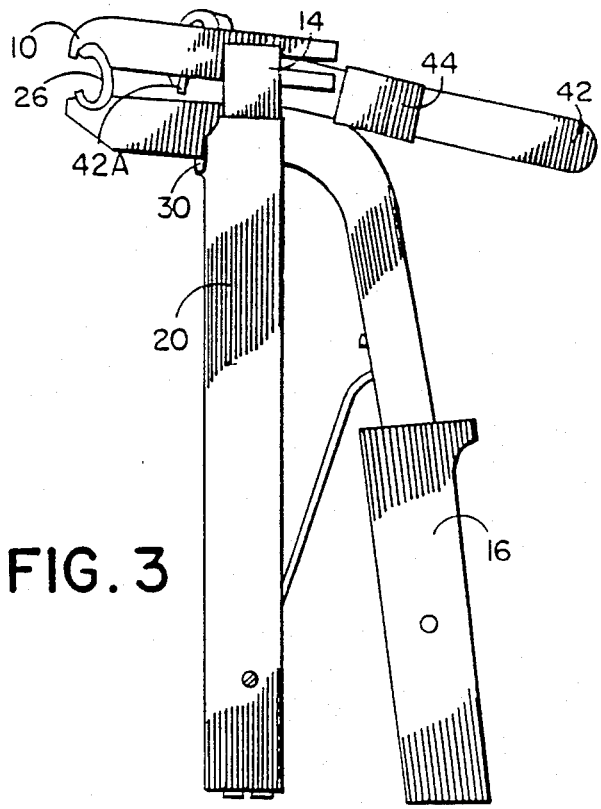
FIG. 3 illustrates the left side of the device of this invention in a first position with the jaws moved forward.
Figure 4:
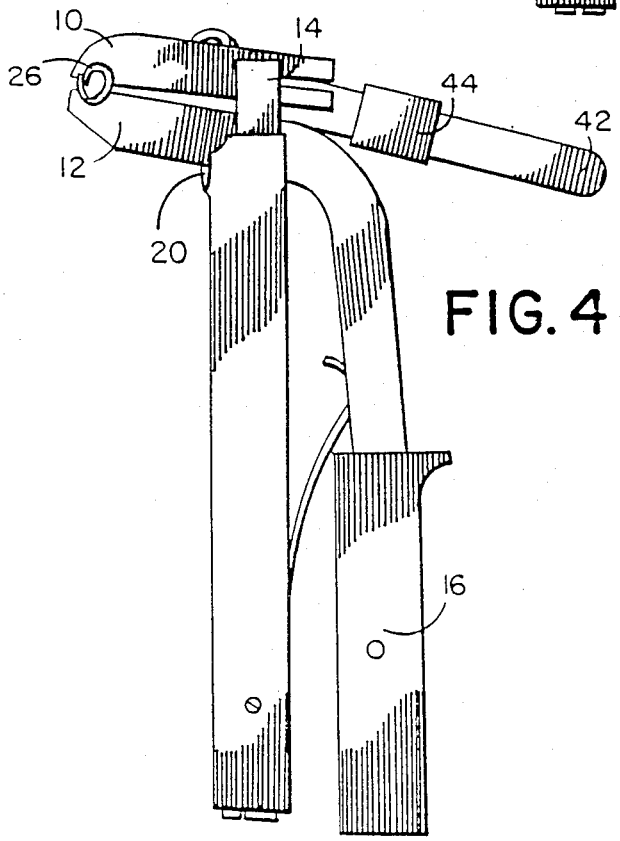
FIG. 4 illustrates a left side view of the device of this invention with the jaws moved forward and clenching the clip.

In the operation of this device, one can grasp rear handle 16 against the palm of one hand and place one's fingers around front handle 20 while clip(s) 26 is held in clip receipt area 24 on clip slide 42 where it has been urged by the pressure of pusher 44 pulled by spring 46. One then, in activation of the tool, moves the base of rear handle 16 forward which action raises lower jaw 12, grasping clip 26 in clip receipt area 24 between lower jaw 12 and upper jaw 10. This raising of lower jaw 12 starts the movement of projection 30A out of hollow 12C. One then continues the movement, pulling the front handle toward the rear handle which moves lower jaw 12 away from the right side of slot 30 and the clip member end 42A by the action of projection 30A moving out of hollow 12C and on to the surface of the right side of lower jaw 12 so that it pushes lower jaw 12 to the left beyond end 42A of clip member 42. In this position as seen in FIG. 3, clip 26 has been grasped and the jaws are starting to move forward through slot 30 and clip slide 42 is passed by the forwardly advancing lower jaw with the next clip urged against the lower jaw. The jaws then are advanced forward by pulling the upper part of the front handle 20 rearward until the front of its hollow portion strikes lever bar 14 and the device is then manually maneuvered to position the clip around what is desired to be clipped together. One then squeezes the base of rear handle 16 inward against the pressure of spring 40 which movement raises lower jaw 12 thereby clenching the clip around what is desired to be clipped together as seen in FIG. 4. One then releases the device, and clip slide 42 which is attached to front handle 20 by clip slide projection 28, moves forward again until it comes to clip receipt area 24 into which the next clip is advanced by the pressure of pusher 44 while the jaws move back to their original position so that projection 30A at the upper portion of slot 30 moves into its mating hollow **12*c* and clip slide 42 then holds the next clip on clip slide 42 itself between jaw members 10 and 12 ready for the action of the next installation. The forward movement of the clip on clip slide 42 is stopped when it strikes the left side of the cutout areas 10B and 12B which are generally shaped in the form of the clip to be received therein. It should be noted that a wider cutout area 10B and 12B** can be utilized which will receive clips of other shapes and styles.

Figure 7:
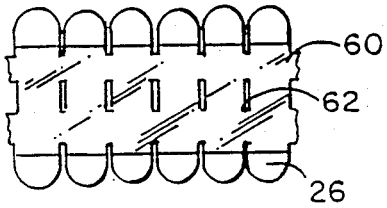
FIG. 7 illustrates a row of clips held together by perforated tape.

While a series of clips can be placed on clip slide 42, most clips for clip guns are sold held together in strips by a piece of tape. Clips used on the clip pliers of this invention can have perforations perpendicular to the row of clips between each adjacent clip. By the starting of the action of closing the jaws, the grasping by the jaws of the clip, and the lateral movement of the jaws in slot 30 caused by the protrusion pushing the jaws to the left, pulling apart the perforated tape at its perforations which tape held each clip to its adjacent clips and when pulled apart, each clip is freed from the remaining clips for installation. As seen in FIG. 7, tape 60 holding such clips 26 together has perforations 62 to assist in this action which perforations and lateral movement of the jaws pulling the engaged clip away from clip slide 42 and the remaining clips in the strip eliminates the need for any cutter member on this device. One embodiment of the tape for retaining clips together is disclosed in my co-pending application for Clip Attachment Tape, Ser. No. 98,962 filed Sept. 21, 1987, now U.S. Pat. No. 4,791,014.

Figure 8:
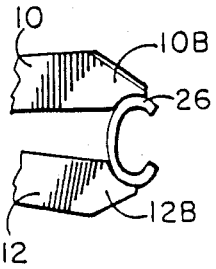
FIG. 8 illustrates alternative cut back jaws.

FIG. 8 shows jaws that are shortened at their ends 70 for use in cases where the ends of the jaws might interfere with the installation as in some upholstery uses.

FIG. 9 shows an enlarged view of the base of handle 20 and lever bar 14.

FIG. 10 illustrates an enlarged view of an alternative embodiment of the base of handle 20 with the lever member 14 shown separated out therefrom. It has been found that the jaws move laterally more easily in slot 30 if second pivot 22 is retained in detented apertures 70 and 72 in the sides of handle 20. The inward protrusion of the metal such as seen at detented aperture 72 in FIG. 10 and also seen along with detented aperture 70 in FIG. 11 help to center lever member 14 between sides 20*a* and 20*b* of handle 20. Between the two sides 14*a* and 14*b* of lever member 14 is disposed the end member 73 in which is defined second adjustment slot 35. Springs 40 and 40*c* passing under post 40*d* disposed between sides 14 and 14*a* of lever member 14 are also clearly seen as they pass down around end member 73. Centering lever member 14 spacing away from sides 20*a* and 20*b* of handle 20 provides for a better lateral movement of the jaws within slot 30 when projection 30*a* moves in and out of mating hollow 12*c* as the jaws are moved forward and rearward. Also an aperture 40*e* is provided defind within side 14*b* of lever member 14 for a protruding portion 40*f* of flat spring member 40 to protrude into for retention of flat spring member 40*a* to prevent it from moving out of alignment with lever bar 14 as it urges the lever bar away from side 20*b* of handle 20.

It should be noted that the device of this invention could be power-operated by means to close the handles of the device in a similar fashion to manual operation, such means being pneumatic closures, solenoid closures or equivalents which are well known in the art.

Although the present invention has been described with reference to particular embodiments, it will be apparent to those skilled in the art that variations and modifications can be substituted therefor without departing from the principles and spirit of the invention.

I claim:

1. A hog ring type clip-applying device comprising:

an upper horizontally extending jaw having a front end and a rear end;

a lower horizontally extending jaw having a front end and a rear end;

a clip receipt area defined between the front ends of said upper jaw and said lower jaw;

a vertically disposed rear handle having a top and a bottom said rear handle attached at its top to the rear end of said lower jaw;

a lever member having a top and a bottom, the top of said lever member being attached at its top to the rear end of said upper jaw;

a vertically disposed front handle having a top and a bottom said front handle having defined in its top a slot having a right side and a left side through which slot said upper and lower jaws are adapted to pass said front handle having a rearward facing hollow area defined in its bottom portion;

a first pivot member pivotally attaching said lever member at a point on said lever member lower than lever member's attachment to said rear end of said upper jaw, to said lower jaw;

a second pivot member pivotally attaching the bottom of said lever member to the bottom of said front handle within said front handle hollow area;

means to center said lever member within said hollow area of said front handle;

means to urge said front handle away from said rear handle for said jaws to be in a clip receipt mode;

a clip slide attachment member affixed to the upper right side of said front handle;

a clip slide for retaining a plurality of clips thereon affixed to said clip slide attachment, said clip slide having a first end disposed at said clip receipt area when said device is in its clip receipt mode and a second end on which clips can be slid to pass into said clip receipt area, said device, when said front and rear handles are grasped by the user and manually moved together, being adapted to grasp a clip and move said jaws through said slot to a position beyond said slot where said clip can be positioned around the objects desired to be clipped together and by further manual pressure on said handles, the jaws clench said clip around the objects to be clipped together;

a projection on the right side of said front handle, said projection protruding into said slot;

a jaw hollow defined in the right side of said lower jaw adapted to receive said projection; and means to urge said lever member and attached jaws to the right side of said slot, said urging means adapted to move said jaws further to the right when said jaw hollow mates with said projection and when said device is utilized and said jaw is moved through said slot, said projection moves out of said hollow and said jaw projection displaces said jaw to the left away from said projection to pass by the first end of said clip slide while retaining said clip between said jaws, said device adapted such that when said front and rear handles are squeezed together, said jaws receive and close around a clip and move forward to said advance position where, by further pressure on said handles, the jaws clench said clip around whatever is desired to be clipped together.

* * * * *